US009016437B2

(12) United States Patent
DiGiovanni et al.

(10) Patent No.: US 9,016,437 B2
(45) Date of Patent: Apr. 28, 2015

(54) PERSONAL STAIR LIFT

(75) Inventors: Anthony P. DiGiovanni, Bradenton, FL (US); Jeffrey R. Moone, Sarasota, FL (US)

(73) Assignee: Hoveround Corporation, Sarasota, FL (US)

( * ) Notice: Subject to any disclaimer, the term of this patent is extended or adjusted under 35 U.S.C. 154(b) by 929 days.

(21) Appl. No.: 12/806,915

(22) Filed: Aug. 24, 2010

(65) Prior Publication Data

US 2012/0048652 A1 Mar. 1, 2012

(51) Int. Cl.
*B66B 9/08* (2006.01)

(52) U.S. Cl.
CPC ..... *B66B 9/0815* (2013.01); *B66B 9/0846* (2013.01)

(58) Field of Classification Search
CPC ..... B66B 5/16; B66B 9/18; B66B 9/0846
USPC ..... 187/202, 352, 355, 200, 201
See application file for complete search history.

(56) References Cited

U.S. PATENT DOCUMENTS

| | | | | |
|---|---|---|---|---|
| 5,476,155 | A * | 12/1995 | Nakatani et al. | 187/202 |
| 5,967,265 | A * | 10/1999 | Bruno et al. | 187/201 |
| 6,761,250 | B1 * | 7/2004 | Szentistvany et al. | 187/201 |
| 8,087,495 | B2 * | 1/2012 | Szentistvany | 187/202 |
| 2004/0104078 | A1 * | 6/2004 | Szentistvany et al. | 187/201 |
| 2010/0274409 | A1 * | 10/2010 | Smith et al. | 700/304 |

FOREIGN PATENT DOCUMENTS

| | | | | |
|---|---|---|---|---|
| WO | WO 2004014773 | A1 * | 2/2004 | B66B 9/08 |

* cited by examiner

*Primary Examiner* — William E Dondero
*Assistant Examiner* — Diem Tran
(74) *Attorney, Agent, or Firm* — Arthur W. Fisher, III

(57) ABSTRACT

A personal stair lift to transport an individual up and down a stairway on a chair assembly supported on a rail mounted rack comprising a carriage assembly configured to support a lift mechanism including a drive member coupled to a reversible drive motor to rotate the drive member wherein the carriage assembly includes at least one pair of upper rollers and at least one pair of lower rollers movably mounted on a stationary rail disposed on each side of the carriage assembly and a rack mounted to one of the stationary rails disposed to engage the drive member to selectively move the chair assembly and person up or down the stairway when the reversible motor rotates the drive member.

11 Claims, 14 Drawing Sheets

PERSONAL STAIR LIFT

BACKGROUND OF THE INVENTION

1. Field of the Invention

A personal stair lift to transport an individual up and down a stairway on a chair supported on a rail mounted rack.

2. Description of the Prior Art

As the population ages the need to improve mobility continues to increase. These needs range from personal mobility vehicles to personal stair lifts. Personal stair lifts provide motorized systems to transport individuals up and down stairways on a seat supported rail mounted rack.

The following patent documents are representative of the prior art relating to personal stair lifts.

U.S. Pat. No. 2,212,388 describes an elevator for use with stairs comprising rail means arranged to support a car and means for supporting the rail means. The supporting means comprises a plurality of clamp means engaging the rail means arranged that the inclination of the rail means is adjustable to correspond to the slope of the stairs.

U.S. Pat. No. 2,888,099 shows a chair lift comprising a rail assembly mounted in a stairway including a load rail and a leveling rail, a carriage mounted upon the rail assembly, a main shaft journalled in the carriage and a seat supporting frame pivotally mounted upon the main shaft. Resilient driving rollers are mounted upon the main shaft in engagement with the load rail. A motor is mounted upon the carriage in driving relationship with the resilient rollers. Leveling rollers are mounted upon the frame in engagement with the leveling rail.

U.S. Pat. No. 4,915,573 shows a stair lift comprising a pair of power jacks linked to a stair or step associated with a vehicle such as a trailer adjacent the vehicle doorway. The jacks operate in tandem to raise or lower the stair or step with a person standing thereon.

U.S. Pat. No. 5,217,089 relates to a motor driven stair lift device operable along the track to move a carrier along the track U.S. Pat. No. 5,992,935 shows a stair lift with a swivel chair comprising a seat pivotally connected to a support having a mechanical activating means for swiveling the seat around the first axis of rotation.

U.S. Pat. No. 7,131,522 teaches a stairs lift system capable of converting stairs climbing operation into a walking movement along a horizontal plane. The system comprises an existing substrate, flight of stairs, and a second, overlying layer of stairs. Each one of the overlying stairs comprises a lifting element. Mechanical, electronic or hydraulic means are provided for lifting the lifting element up to the height of next-in-line overlaying stair. The lifting means are activated when sensing the presence of a subject having stepped on the first-in-line lifting element. The first-in-line lifting element returns to the initial position once the subject has stepped over to the next-in-line stair; and so forth.

U.S. Pat. No. 7,140,475 teaches a motor brake coupled to the rotatable motor drive shaft. The brake includes a shaft-mountable support that rotates uniformly with the drive shaft. One or more brake shoes, which can include flyweights or the like, are hingedly mounted to the support and include brake pads. A centripetal force is applied to the brake shoes using one or more springs or other biasing means that bias the brake pads against a braking surface when rotation of the shaft is below a minimum rotational velocity. The brake pads disengage from the braking surface when shaft rotation exceeds the minimum rotational velocity. The centrifugal force induced and applied to the brake shoes and brake pads by rotation of the motor drive shaft overcomes the biasing force to disengage the brake pads from the braking surface, which may be the housing of a motor to which the brake is affixed. U.S. Pat. No. 7,156,208 shows a stair lift comprising a lift assembly driven along a rail including a chassis supporting a load bearing member such as a seat. The chassis is formed by a main member on which are mounted a drive assembly and a leveling assembly for maintaining the seat horizontal by altering the orientation of the chassis with respect to the rail as the lift assembly moves along the rail. One or both of the drive and leveling assemblies may be pivotally mounted on the chassis to permit rotation about a vertical axis so as to accommodate bends in the rail.

U.S. Pat. No. 7,225,899 relates to a stair lift for lifting and lowering a person on a rail on a stairway comprising a carriage mountable to the rail having a track engaging drive, and a motor to power the drive, the powered drive causing the carriage to move along the rail. There is a central support post mounted on the carriage and an offset arm connected to the seat support post. The offset arm is mounted to the carriage in one of a left side or a right side position. A seat is mounted on the offset arm. A notched late secures the seat in position on the offset arm in either the left side or right side position and permits the seat to swivel between a sideways facing position and an upward facing position to facilitate the person getting into and out of the seat.

U.S. Pat. No. 7,600,611 describes a stairlift comprising a rail combination with a carriage and footrest which allows the footrest to be positioned below the level of the first step.

US 2008/0203775 relates to a stairlift chair in which the seat and armrests move simultaneously when the chair is folded. In a preferred embodiment the footrest also folds, with the armrests and seat, when the chair is folded.

Other patent documents include U.S. Pat. Nos. 4,174,023; 7,568,555; JP 2127383 (A) and JP 2005213011 (A).

SUMMARY OF THE INVENTION

The present invention relates to a personal stair lift to move or transport an individual up and down a stairway on a chair assembly supported on a rail assembly by a chassis assembly powered by a lift mechanism.

The rail assembly comprises a base having a stationary substantially oval rail formed on the upper portion of opposite sides of the base each including a transmission channel formed on the inner portion thereof to receive a portion of the lift mechanism and a transmission guide channel formed on the upper portion of the base beneath and between the transmission channels.

The rail assembly may include a plurality of substantially oval rail sections coupled together by a pair of rail section retaining plates slipped into place in an upper rail section retaining slot and the lower rail section retainer slot and secured in place by fasteners or screws. In addition, a pair of rail section alignment members including an enlarged end portion may be press-fitted into a corresponding retention groove formed on the end portion of each substantially oval rail sections and a reduced end portion slipped into a corresponding retention groove formed on the end portion of adjacent substantially oval rail section.

The chair assembly comprises a back rest and a seat attached to the chassis assembly by a chair mounting assembly comprising a lower mounting member attached to the side of the chassis assembly and an upper mounting member telescopingly coupled to the lower mounting member including mounting plate having a mounting pivot extending upwardly therefrom to be rotatably disposed within a recess formed in a cross-member affixed to the bottom of the seat.

The chassis assembly comprises an upper set of rollers and a lower set of rollers held in a rolling engagement with the upper substantially oval surface and the lower substantially oval surface of the stationary substantially oval rails respectively. The upper set of rollers may comprise a pair of first upper rollers disposed on opposite sides of the rail assembly to engage the upper substantially oval surface of the corresponding substantially oval rail and a pair of second upper rollers disposed on opposite sides of the rail assembly adjacent the first upper roller on the same side of the rail assembly to engage the lower substantially oval surface of the corresponding substantially oval rail and a pair of second lower rollers disposed on opposite sides of the rail assembly adjacent the first lower roller on the same side of the rail assembly to engage the lower substantially oval surface of the corresponding substantially oval rail.

The lift mechanism comprises a reversible drive motor coupled to a transmission assembly by an output drive shaft to selectively move the chassis assembly and the chair assembly along the rail assembly to transport a person seated on the chair assembly up or down the stairway. The transmission assembly comprises a substantially horizontal rack disposed within one of the transmission channels formed on the inner portion of one of the stationary substantially oval rails and a substantially horizontal gear disposed in operative engagement with the substantially horizontal rack coupled to the output drive shaft of the reversible drive motor and partially disposed with the transmission channel formed on the inner portion of the opposite or other stationary substantially oval rail. A transmission engagement member is mounted on the output drive shaft to engage the side wall of the transmission guide channel opposite the substantially horizontal rack to maintain vertical alignment of the output drive shaft and the operative engagement between the substantially horizontal rack and the substantially horizontal gear or drive member.

The personal stair lift may further includes a braking assembly to stop movement of the chair assembly and the chassis assembly along the rail assembly when the chassis assembly exceeds a predetermined speed.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
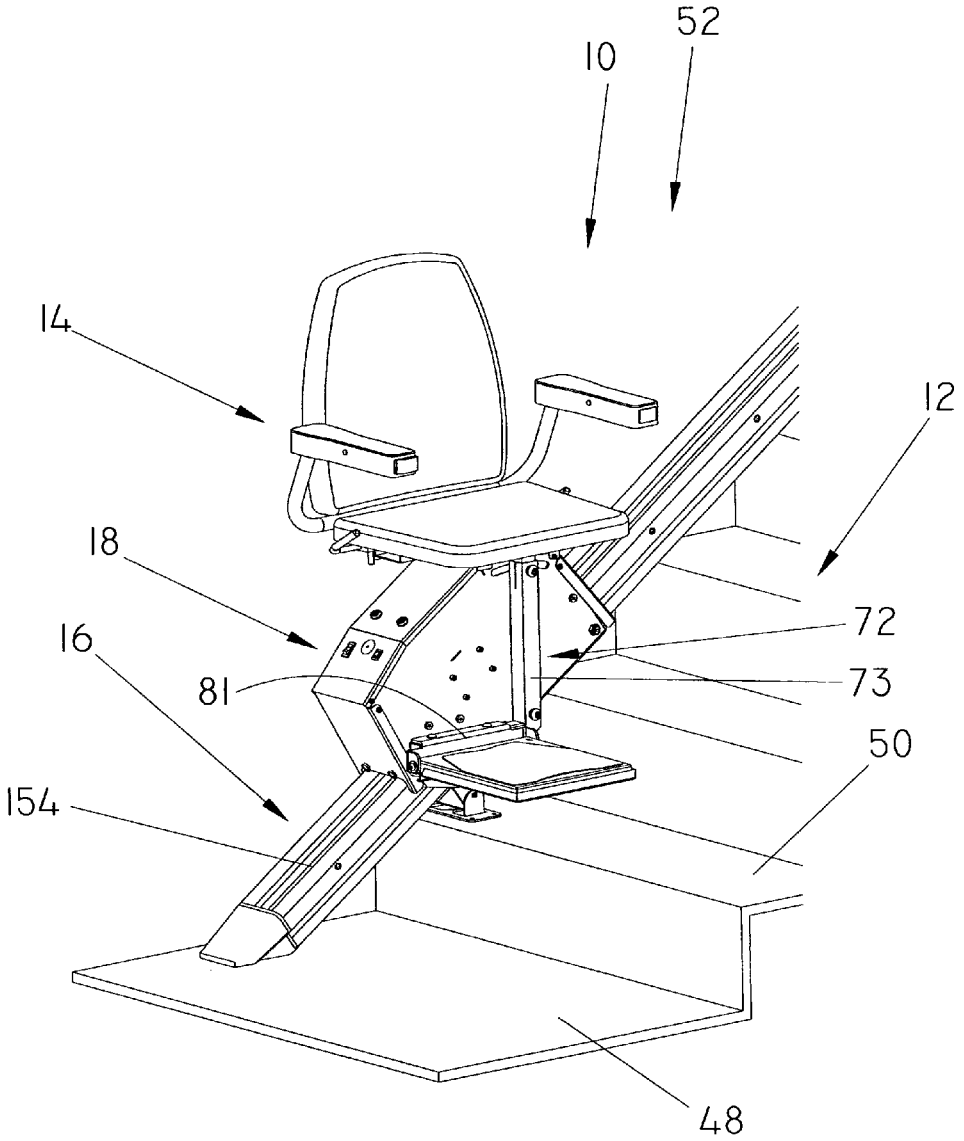
FIG. 1 is a perspective view of the personal stair lift of the present invention mounted in operative relationship relative to a stairway.
Figure 2:
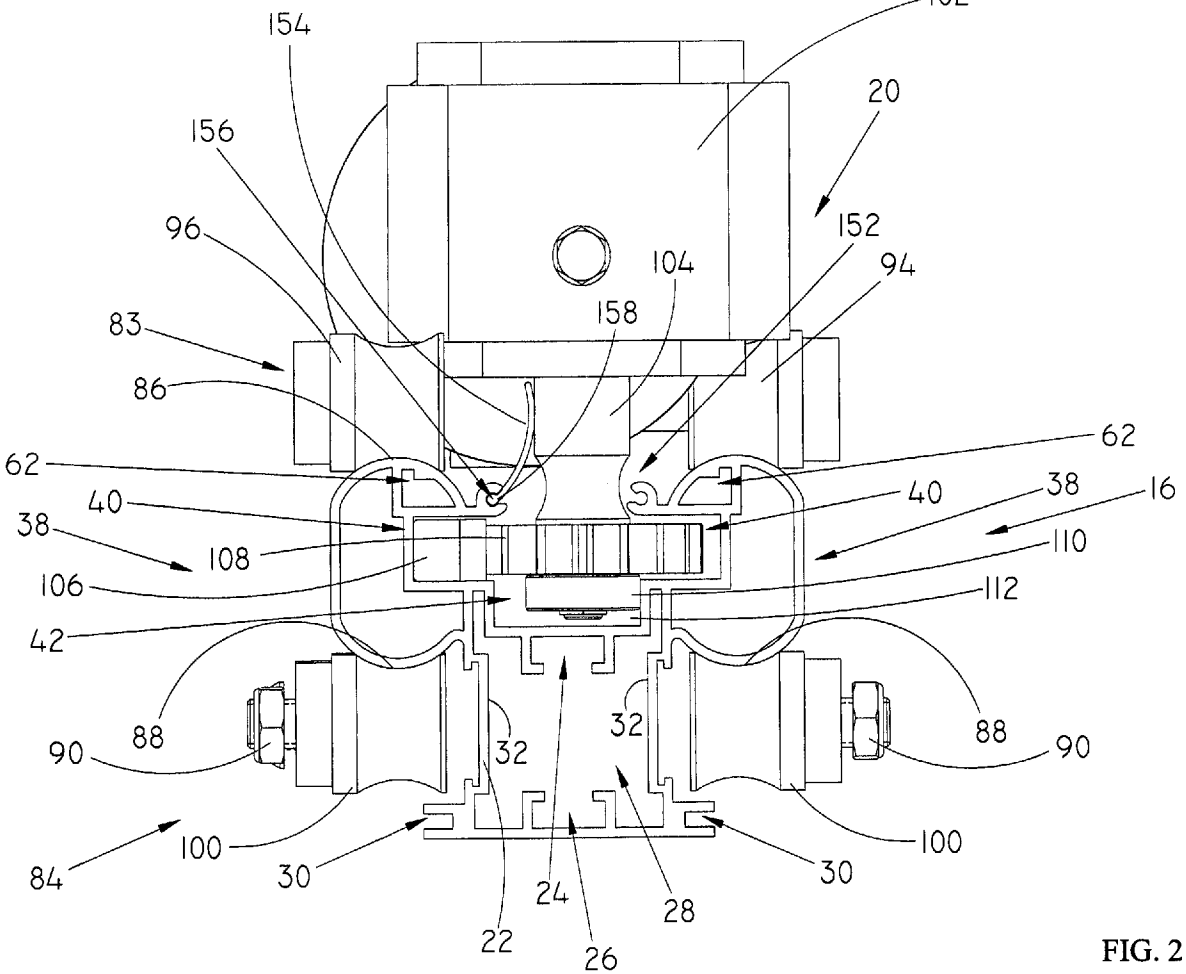
FIG. 2 is a detailed end view of the chassis assembly and the lift mechanism of the personal stair lift of the present invention.
Figure 3:
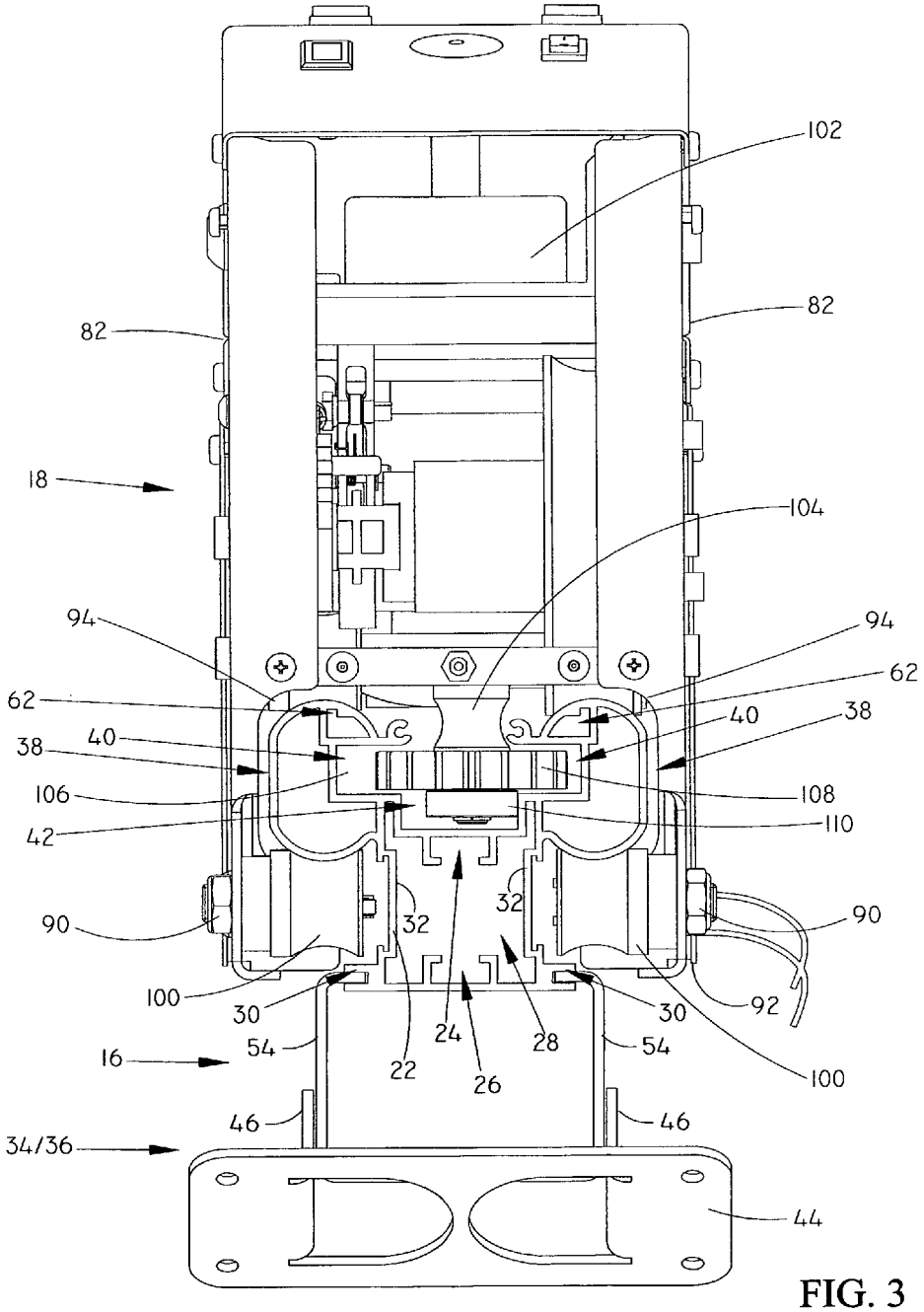
FIG. 3 is an end view of the personal stair lift of the present invention.
Figure 6:
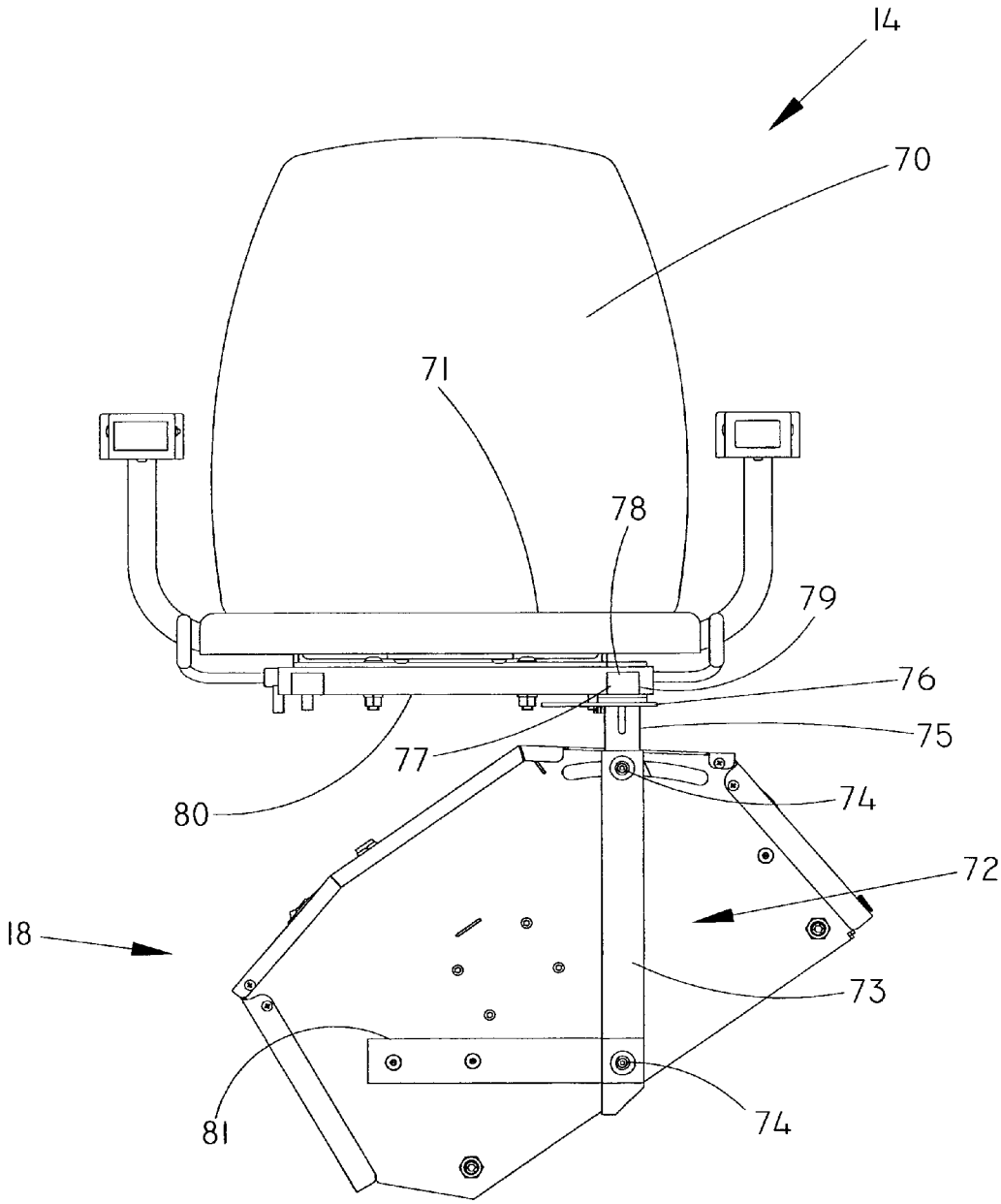
FIG. 6 is a front view of the chair assembly and chair mounting assembly of the personal stair lift of the present invention.

As shown in FIG. 1, the present invention relates to a personal stair lift generally indicated as 10 to move or transport an individual up and down a stairway 12 on a chair assembly generally indicated as 14 supported on a rail assembly generally indicated as 16 by a chassis assembly generally indicated as 18 and a lift mechanism generally indicated as 20 (FIGS. 2, 3 and 6).

Figure 4:
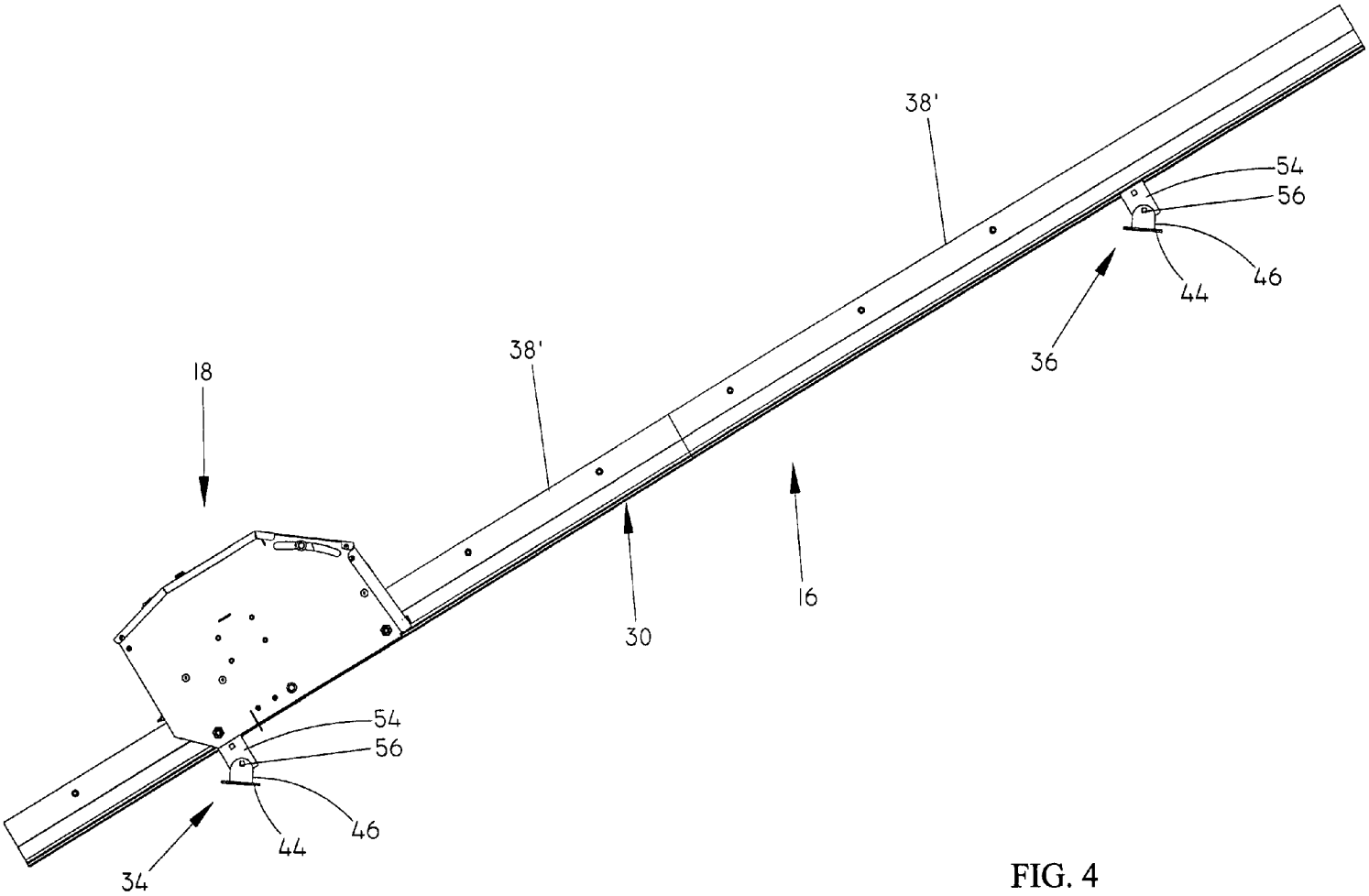
FIG. 4 is a side view of the chassis assembly and rail assembly of the personal stair lift of the present invention.

As shown in FIGS. 2 through 4, the rail assembly 16 comprises a hollow channel or base 22 having an upper rail section retaining slot 24 and a lower rail section retaining slot 26 formed on the interior 28 of the hollow channel or base 22 having a rail mounting groove 30 formed on the lower portion of opposite sides 32 of the hollow channel or base 22 to receive a portion of a lower rail mount assembly and a portion of an upper rail mount assembly generally indicated as 34 and 36 respectively as shown in FIG. 4 and a stationary substantially oval rail generally indicated as 38 formed on the upper portion of opposite sides 32 of the hollow channel or base 22 each including a transmission channel 40 formed on the inner portion thereof to receive a portion of the lift mechanism 20 as described more fully hereinafter and a transmission guide channel 42 formed on the upper portion of the hollow channel or base 22 beneath and between the transmission channels 40.

As best shown in FIGS. 3 and 4, the lower rail mount assembly 34 and the upper rail mount assembly 36 each comprises a stationary substantially flat mounting bracket 44 having a pair of pivot mounting flanges each indicated as 46 extending therefrom fixed to the floor 48 or a stair 50 adjacent the wall 52 next to the stairway 12 and a pair of substantially L-shaped rail mounting members each indicated as 54 pivotally coupled to the corresponding pivotal mounting flange 46 by a corresponding mounting pin 56 configured to be disposed in the corresponding rail mounting groove 30 on opposite sides 32 of the hollow channel or base 22.

Figure 5:
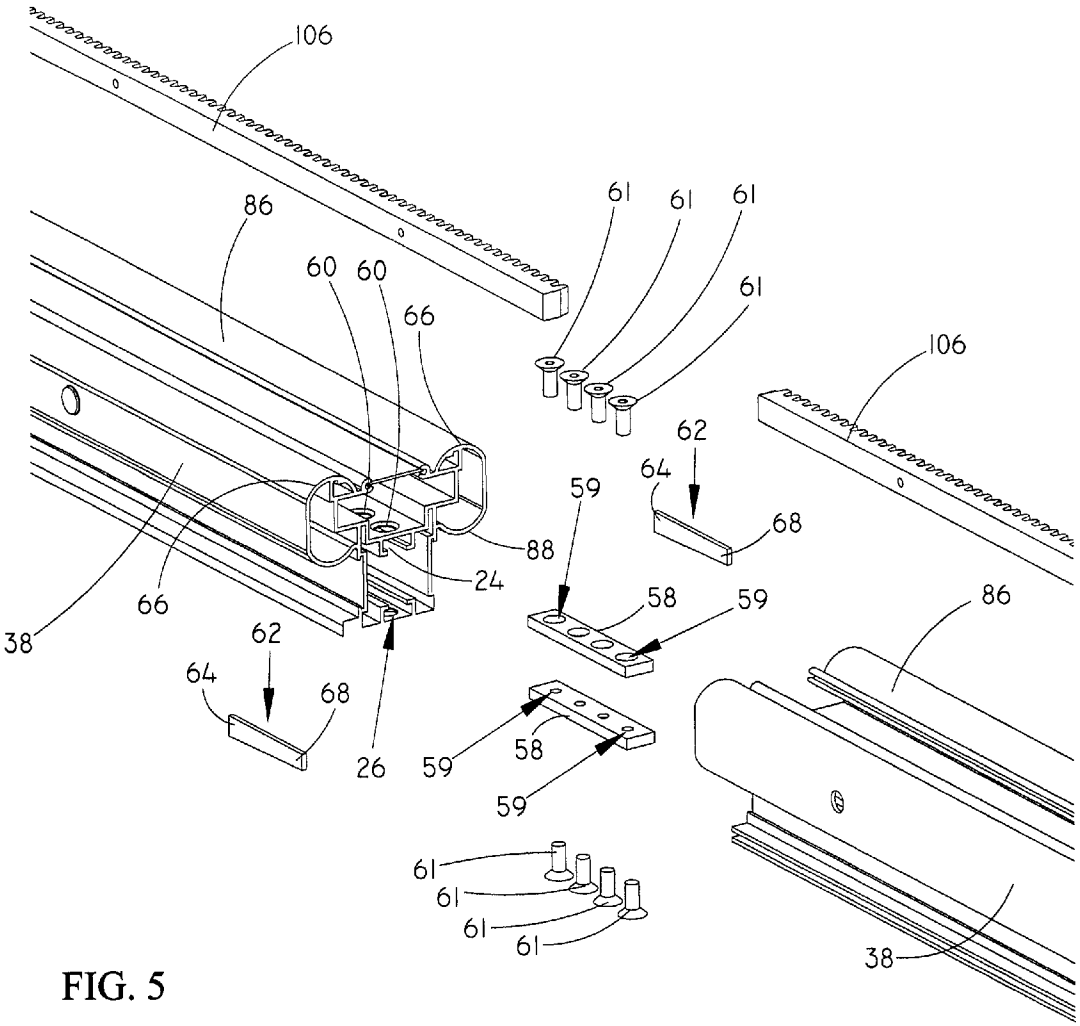
FIG. 5 is a detailed exploded perspective view of adjacent rail sections together with the section retaining plates and the section alignment members of the personal stair lift of the present invention.

As shown in FIG. 5, the rail assembly 16 may include a plurality of stationary substantially oval rail sections 38' coupled together by a pair of substantially horizontally disposed rail section retaining plates each indicated as 58 including a plurality of plate retaining apertures each indicated as 59 slipped into place in the upper rail section retaining slot 24 and the lower rail section retainer slot 26 aligning each retaining aperture 59 with a corresponding rail retaining aperture 60 formed on the end portion of the adjacent substantially oval rail section 38' and secured in place by fasteners or screws each indicated as 61. The rail retaining apertures 60 have a central axis inclined relative to the longitudinal center line of each substantially oval rail section 38' such that the fasteners or screws 61 pull adjacent substantially oval rail sections 38' together in alignment relative to each other.

In addition, a pair of substantially vertically disposed rail section alignment members each generally indicated as 62 including an enlarged end portion 64 may be press-fitted into a corresponding alignment groove 66 formed on the end portion of each stationary substantially oval rails sections 38' and a reduced end portion 68 to be slipped into the corresponding alignment groove 66 formed on the end portion of the adjacent substantially oval rails 38'.

Figure 7:
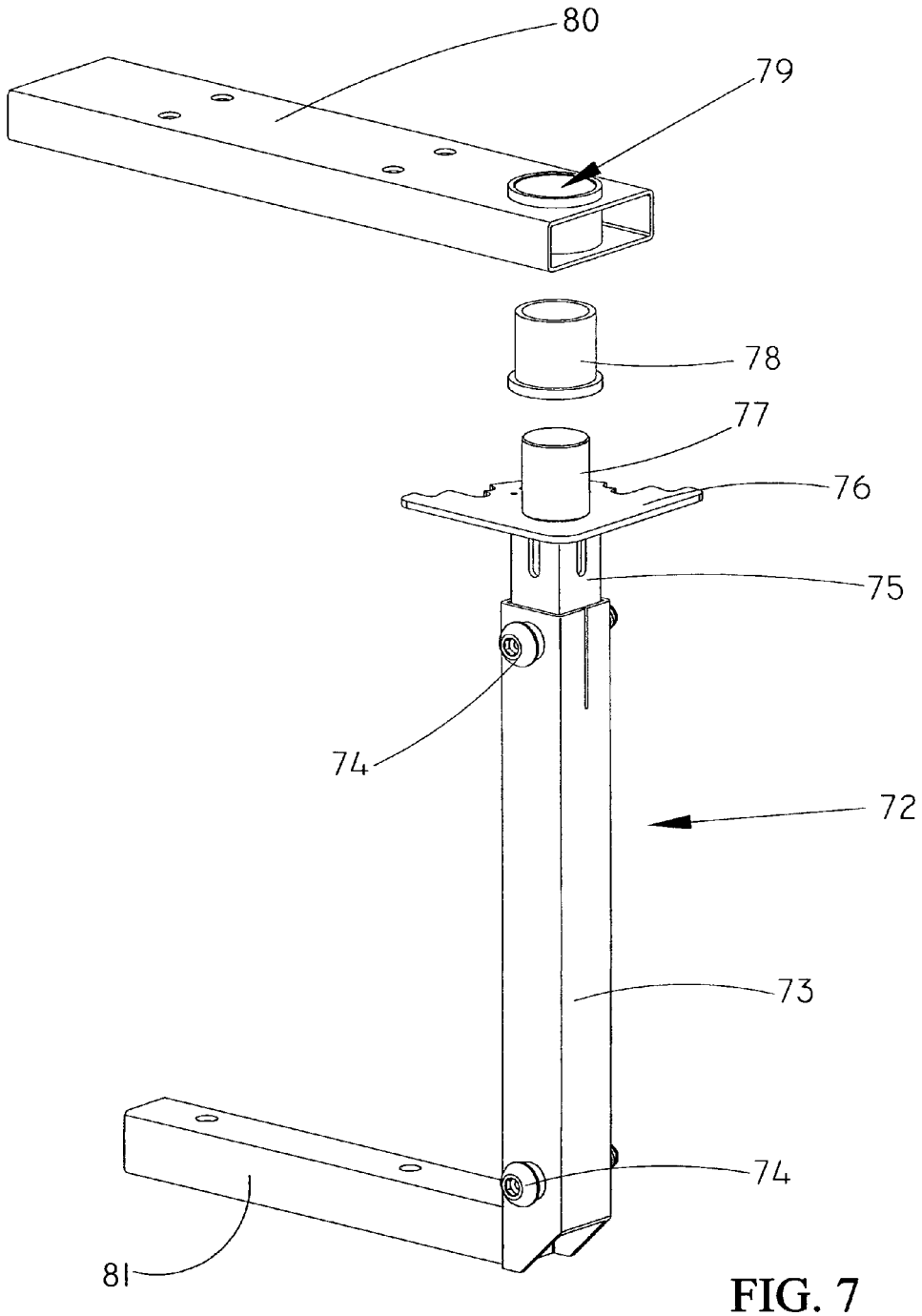
FIG. 7 is a detailed view of the substantially vertical lower mounting member and the upper mounting member of the personal stair lift of the present invention.

As best shown in FIGS. 6 and 7, the chair assembly 14 comprises a back rest 70 and a seat 71 attached to the chassis assembly 18 by a chair mounting assembly generally indicated as 72. The chair mounting assembly 72 comprises a substantially vertical lower mounting member 73 detachably attached to the side of the chassis assembly 18 by a plurality of fasteners each indicated as 76 and a substantially vertical upper mounting member 75 telescopingly coupled to the substantially vertical lower mounting member 73 including a substantially horizontal mounting plate 76 having a mounting post 77 extending upwardly therefrom to be rotatably disposed within a sleeve 78 disposed with a recess or channel 79 formed in a seat support cross-member 80 detachably mounted to the bottom of the seat 71. A substantially horizontal lower mounting member 81 is attached to the lower portion of the substantially vertical lower mounting member 73 and the detachably attached chassis assembly 18. Since the substantially vertical lower mounting member 73 and the substantially horizontal lower mounting member 81 are detachably attached to the chassis assembly 18 and the seat support cross-member 80 is detachably mounted to the bottom of the seat 71, the chair assembly 14 may be reversed when the personal stair lift 10 is mounted on the opposite side of the stairway 12.

As best shown in FIGS. 2 and 3, a pair of side plates each indicated as 82 encloses the chassis assembly 18 and the lift mechanism 20 therein in operative relationship relative to the rail assembly 16.

Figure 8:
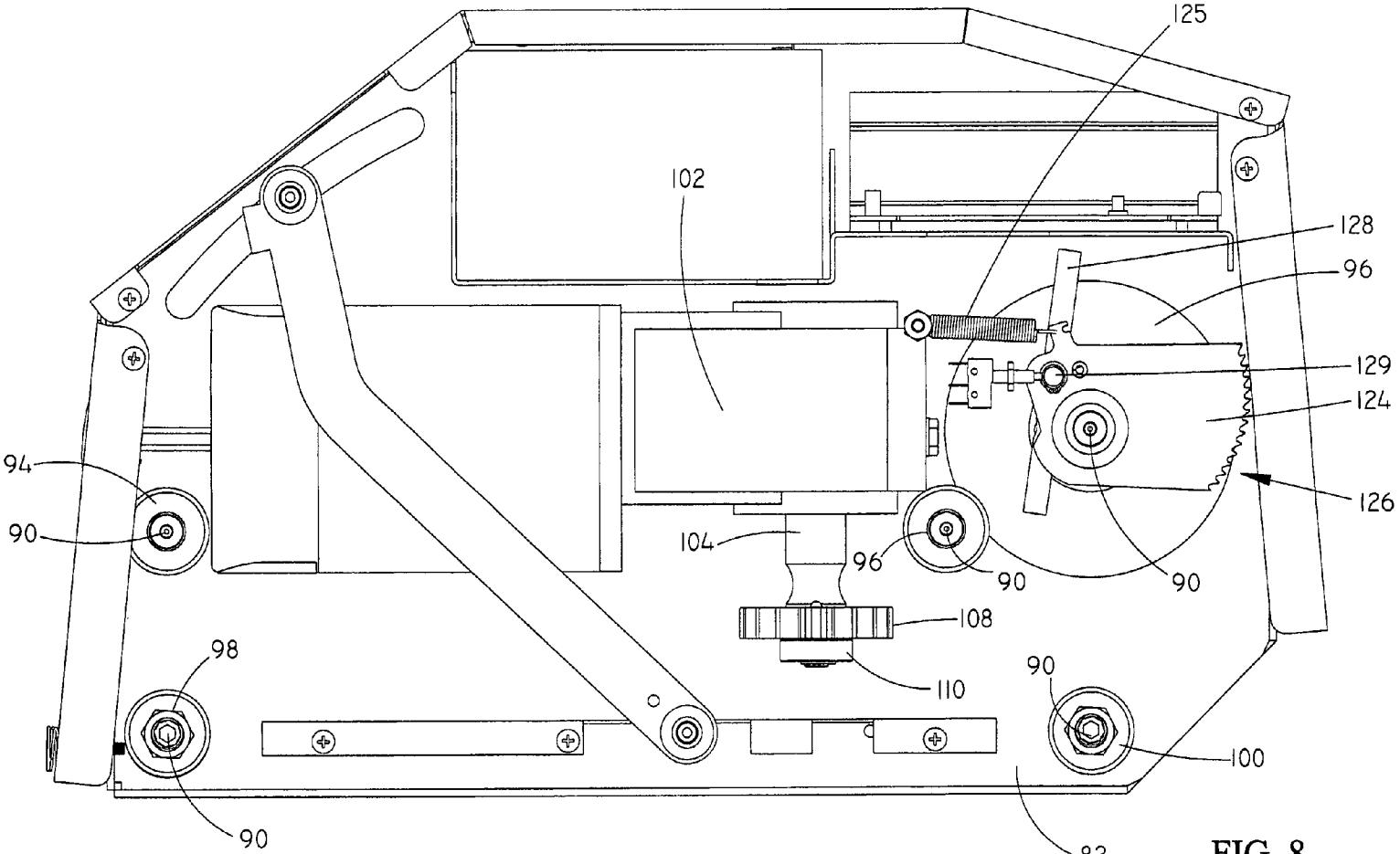
FIG. 8 is a side view of the chassis assembly and the lift mechanism of the personal stair lift of the present invention.

As best shown in FIGS. 2, 3, and 8, the chassis assembly 18 comprises an upper set of rollers generally indicated as 83 and a lower set of rollers generally indicated as 84 held in rolling engagement with the upper substantially oval surface 86 and the lower substantially oval surface 88 of the stationary substantially oval rails 38 respectively by corresponding mounting pins or shafts each indicated as 90 coupled to a roller bracket 92 attached to the corresponding side 82. The upper set of rollers 83 comprises a pair of first upper rollers indicated as 94 disposed on opposite sides of the rail assembly 16 to engage the upper substantially oval surface 86 of the corresponding stationary substantially oval rail 38 and a pair of second upper rollers indicated as 96 and 96' disposed on opposite sides of the rail assembly 16 adjacent the first upper roller 94 on the same side of the rail assembly 16 to engage the upper substantially oval surface 86 of the corresponding substantially oval rail 38; while the lower set of rollers 84 comprises a pair of first lower rollers each indicated as 98 disposed on opposite sides of the rail assembly 16 to engage the lower substantially oval surface 88 of the corresponding stationary substantially oval rail 38 and a pair of second lower rollers each indicated as 100 disposed on opposite sides of the rail assembly 16 adjacent the corresponding first lower roller 98 on the same side of the rail assembly 16 to engage the lower substantially oval surface 88 of the corresponding substantially oval rail 38.

As best shown in FIGS. 2, 3, and 8, the lift mechanism 20 comprises a reversible drive motor 102 coupled to a transmission assembly by an output drive shaft 104 to selectively move the chassis assembly 18 and the chair assembly 14 along the rail assembly 20 to transport a person seated on the chair assembly 14 up or down the stairway 12. The transmission assembly comprises a substantially horizontal rack 106 disposed within one of the transmission channels 40 formed on the inner portion of one of the stationary substantially oval rails 38 and a substantially horizontal gear 108 disposed in operative engagement with the substantially horizontal rack 106 coupled to the output drive shaft 104 of the reversible drive motor 102 and partially disposed within the transmission channel 40 formed on the inner portion of the opposite or other stationary substantially oval rails 38. A transmission engagement member such as a roller or cam 110 is mounted on the output drive shaft 104 to engage the side wall 112 of the transmission guide channel 42 opposite the substantially horizontal rack 106 to maintain vertical alignment of the output drive shaft 104 and the operative engagement between the substantially horizontal rack 106 and the substantially horizontal gear or drive member 108.

Figure 11:
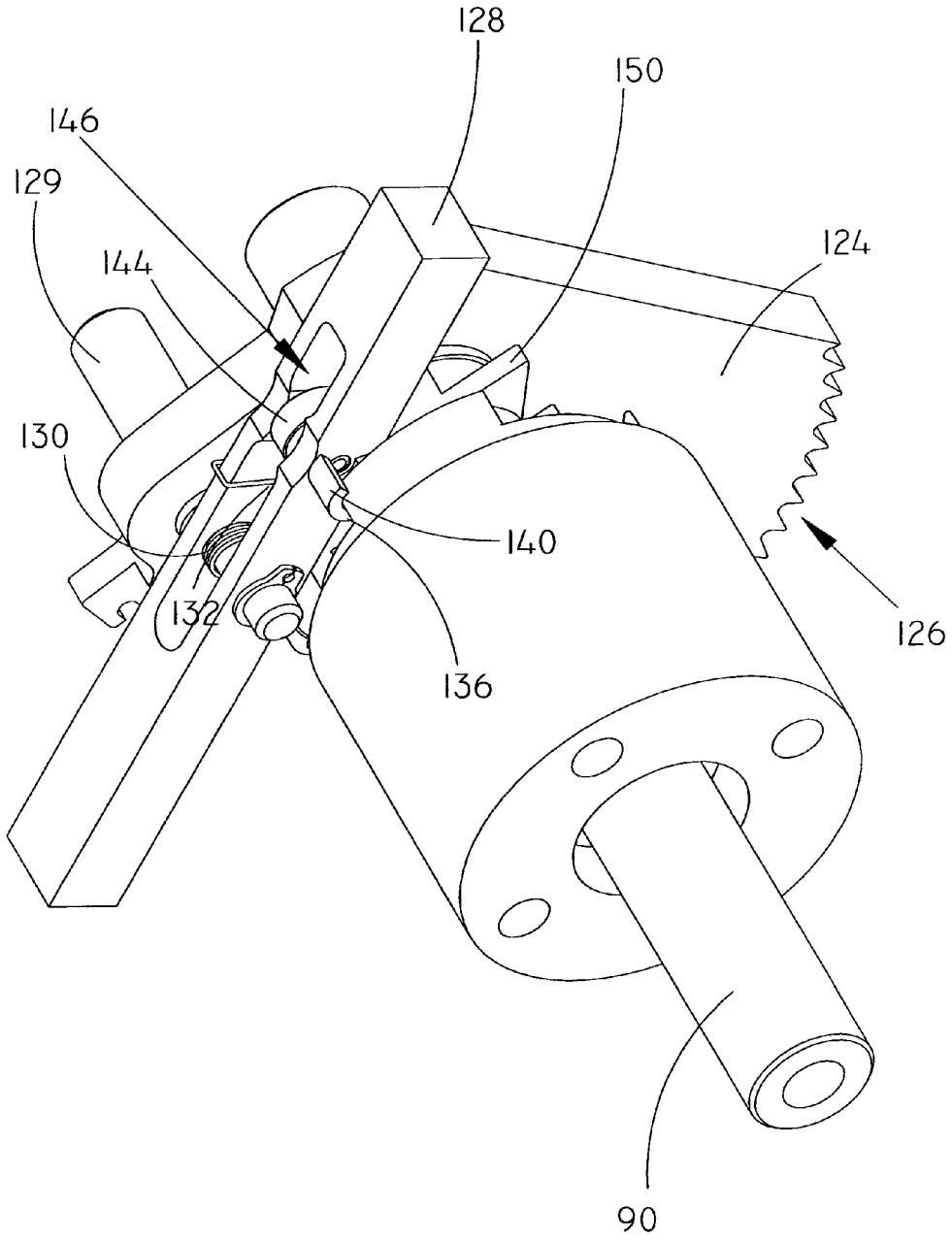
FIG. 11 is a perspective view of the brake assembly of the personal stair lift of the present invention in the braking position.

As shown in FIGS. 8 through 13, the personal stair lift 10 further includes a brake assembly to stop movement of the chair assembly 14 and the chassis assembly 18 along the rail assembly 16 when the chassis assembly 18 exceeds a predetermined speed. The brake assembly comprises a brake drive member or the larger of the second pair of upper rollers 96' rotatably mounted to the forward portion of the chassis assembly 18 and disposed to engage the substantially oval upper surface 86 of the stationary substantially oval rails 38 opposite the rack 106 mounted on one end portion of a corresponding pin or shaft 90 and a brake member 124 including a plurality of braking elements or teeth generally indicated as 126 pivotally mounted to the opposite end portion of the corresponding pin or shaft 90. The brake member 124 is normally held or retained in a first or neutral position (FIG. 8) by a brake retainer member or bias 125 such that the plurality of braking elements or teeth 126 are held out of engagement with the substantially oval upper surface 86 of the stationary substantially oval rail 38 having the rack 106 mounted thereon. The brake assembly further includes a brake mechanism movable between a first or neutral position and a second or braking position comprising an actuator member 128 pivotally coupled to the brake member 124 by a pivot member 129 normally held or retained in a first position (FIG. 9) by an actuator retainer member or bias 130 and a brake actuator pin 132 affixed to the brake member 124 adjacent the actuator member 128 such that when the chair assembly 14 and the chassis assembly 18 exceed a predetermined speed rotation of the brake drive member or roller 96' actuates a brake actuator positioning assembly as described more fully hereinafter causing the actuator member 128 to pivot against the force of the actuator retainer member or bias 130 engaging the brake actuator pin 132 rotating the brake member 124 on the brake shaft or pin 90 against the force of the brake retainer member or bias 125 causing the plurality of braking elements or teeth 126 to engage the substantially oval upper surface 86 of the stationary substantially oval rails 38 to stop the chair assembly 14 and the chassis assembly 18 (FIG. 11).

The brake actuator positioning assembly comprises a first brake actuator member positioning mechanism generally indicated as 133 to control the pivotal movement of the brake actuator member 128 relative to the brake drive member or roller 96' and pin or shaft 90 and a second brake actuator member positioning mechanism to control the movement of the brake actuator member 128 relative to the brake actuator pin 132.

Figure 12:
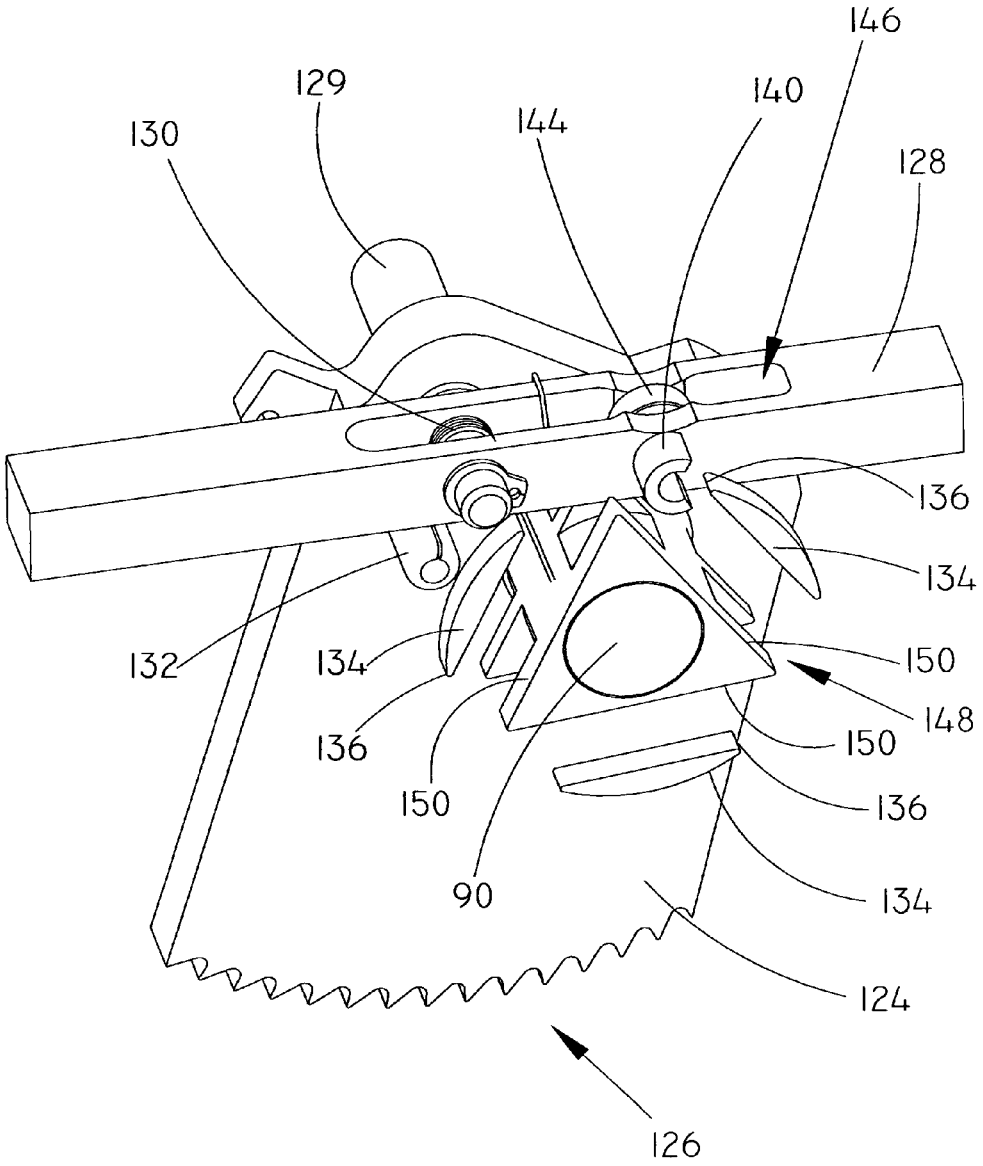
FIG. 12 is a partial cut-away detail view of the brake assembly of the stair lift of the present invention in the neutral brake position.
Figure 13:
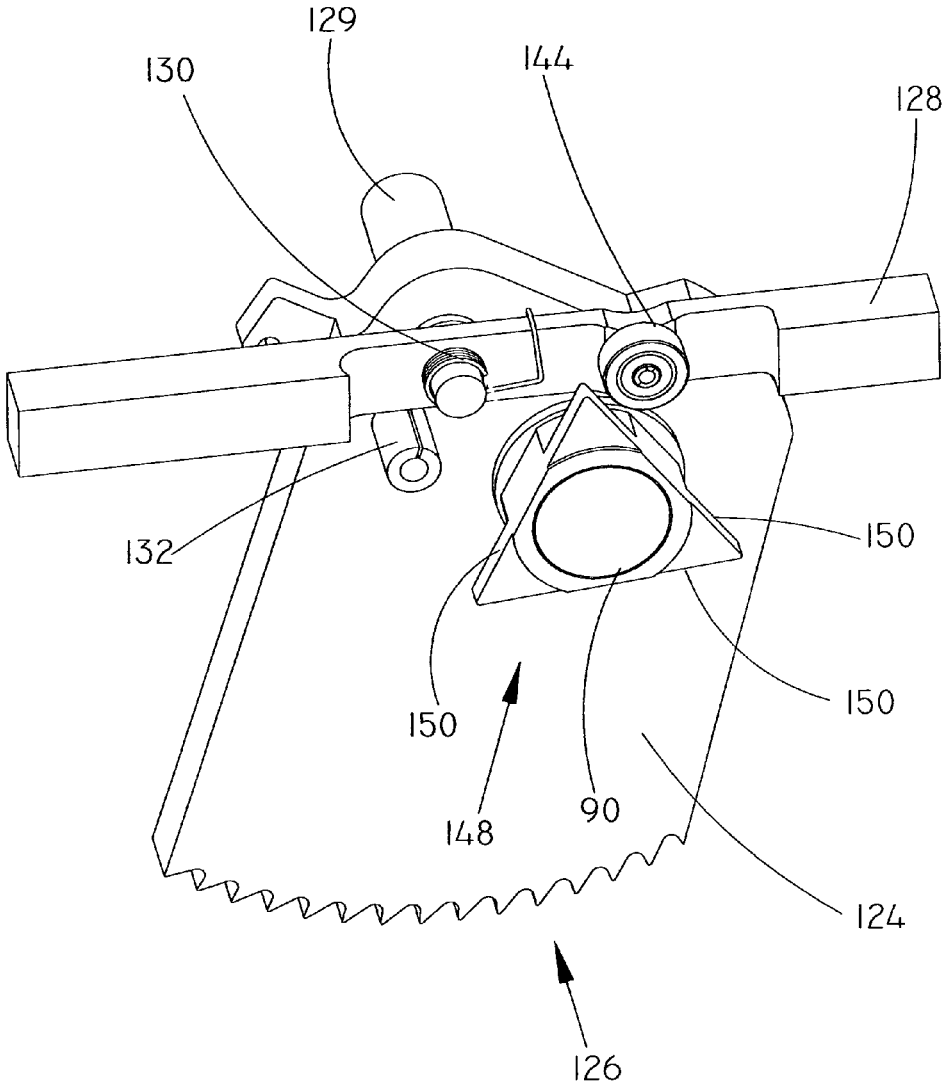
FIG. 13 is partial cut-away detail view of the brake assembly of the stair of the present invention in the brake transitioning position.
Figure 15:
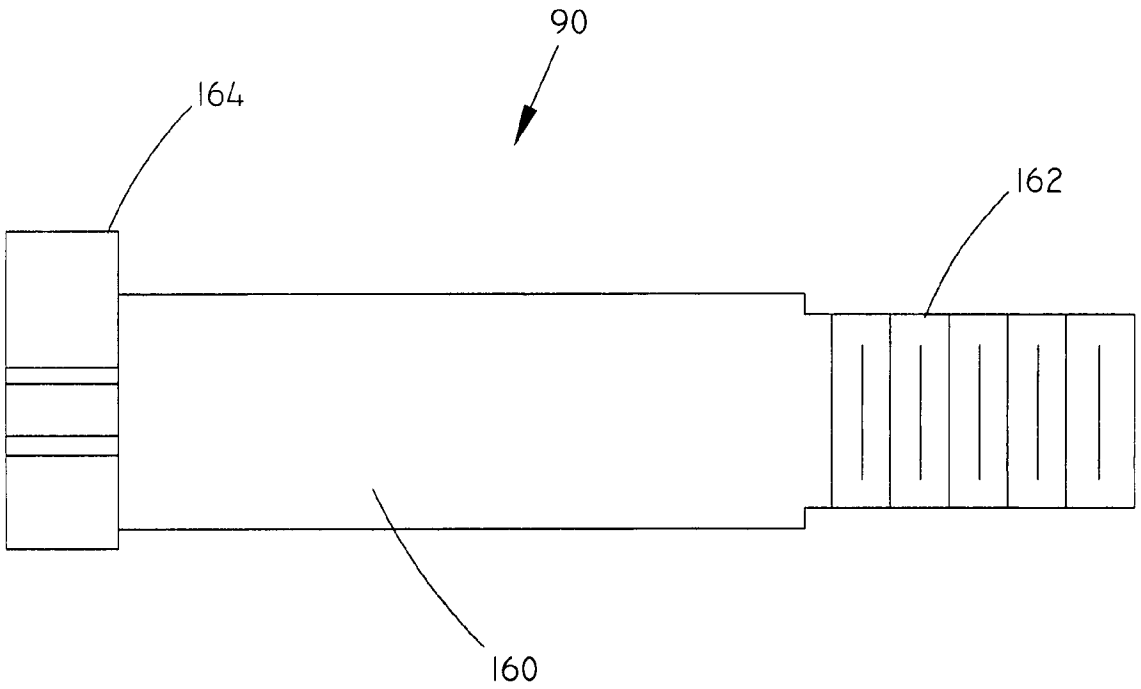
FIG. 15 is a side view of a roller of the stair lift of the present invention.
Figure 14:
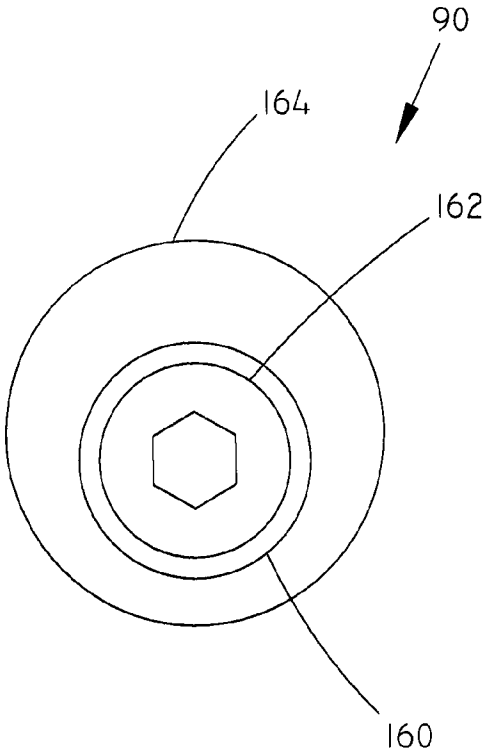
FIG. 14 is a front view of a roller of the stair lift of the present invention.

The first brake actuator member positioning mechanism comprises a first actuator positioning element 134 including a first engagement surface 136 formed in a circular flange 138 affixed to the pin or shaft 90 to rotate with the brake drive member or roller 120 and a second actuator positioning element 140 including an actuate or concave seat 142 affixed to the brake actuator member 128 disposed to selectively engage each other in response to the operation of the second brake actuator member positioning mechanism. As shown in FIG. 12, the first brake actuator member positioning mechanism may comprise a plurality of first actuator positioning elements 134.

The second brake actuator member positioning mechanism comprises a cam roller 144 rotatably mounted within a slot or recess 146 formed through or in the brake actuator member 128 adjacent the second actuator positioning element 140 and a cam generally indicated as 148 including a plurality of cam surfaces each indicated as 150 corresponding to the plurality of first actuator positioning elements 134 attached to the brake pin or shaft 90 disposed to engage the cam roller 144 as the brake drive member 96' and the brake shaft 90 rotate.

Figure 9:
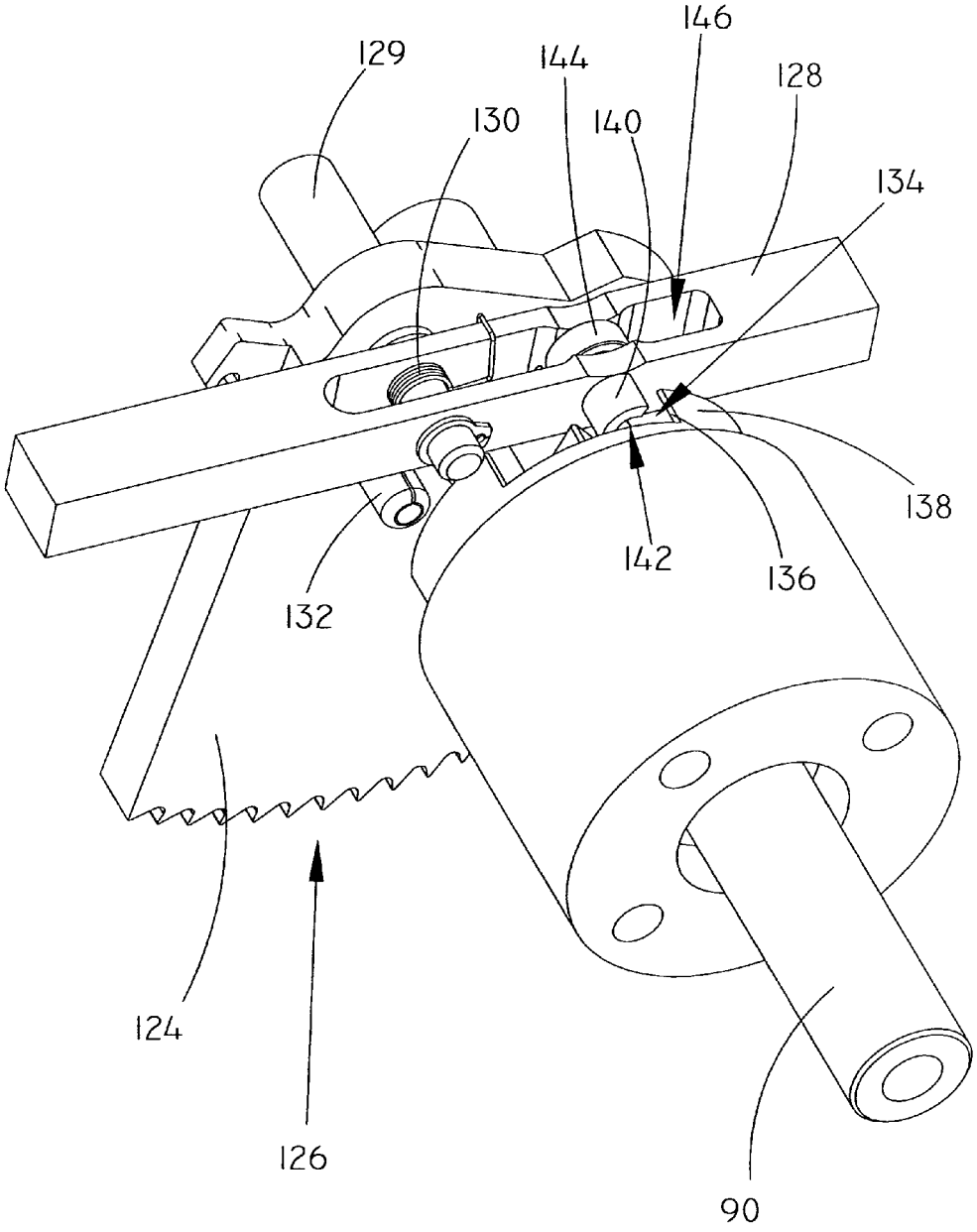
FIG. 9 is a perspective view of the brake assembly of the personal stair lift of the present invention in the neutral brake position.
Figure 10:
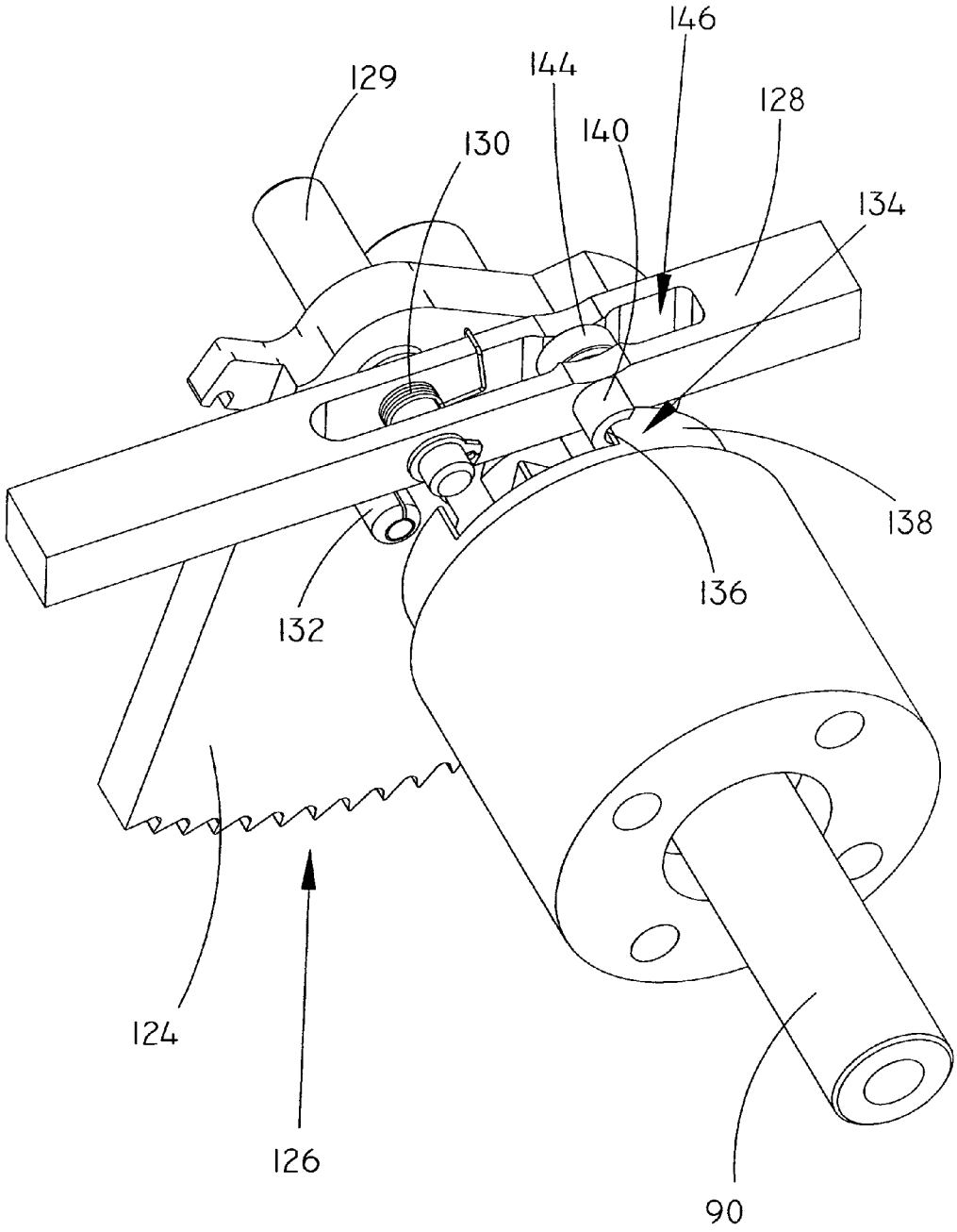
FIG. 10 is a perspective view of the brake assembly of the personal stair lift of the present invention in the brake transitioning position.

Under normal operating conditions as the personal stair lift 10 travels along the rail, engagement between the cam roller 144 and the cam surfaces 150 of the cam 148 in combination with the actuator retainer member or bins 130 cause the brake actuator arm or member 128 to rock or oscillate on the pivot member 129 allowing the second actuator positioning element 140 to clear beneath the first engagement surface 136 of the first actuator positioning element 134 (FIG. 9). When the speed of the personal stair lift 10 exceeds a predetermined level the speed of rotation of the brake drive member or forward upper roller 96' rotates the brake shaft or pin 90 at an increased speed increasing the rotational speed of the cam 148 and the cam surfaces 150 engaging the cam roller 144 such that the brake actuator arm or member 128 is rotated to the second position against the force of the actuator retainer member or bias 130 or sufficient period of time causing a first engagement surface 136 of the first actuator positioning element 134 to engage the second actuator positioning element 140 (FIG. 10) rotating the brake actuator arm or member 128 against the brake actuator pin 132 to rotate the brake member 124 until the plurality of elements or teeth 126 engage the upper substantial oval surface 86 of an stationary substantially oval rail to stop the personal stair lift 10 (FIG. 11). The brake assembly is manually released once deployed and the stair lift has stopped. A switch device (not shown) deactivated the reversible drive motor 102 when the brake assembly is deployed.

As shown in FIGS. 1 and 2, the longitudinal space or trough 152 between the stationary substantially oval rails 38 is protected or covered by an elongated substantially flat flexible strip or member 154 including a longitudinally disposed peripheral bead or protrusion 156 attached or mounted to the inner portion of one of the stationary substantially oval rails 38 including a mounting groove 158 to operatively receive the longitudinally disposed peripheral bead or protrusion 156 therein. As shown in FIG. 2, the output shaft 104 engages the elongated substantially flat flexible strip or member 154 as the personal stair lift 10 travels along the stationary substantially oval rails 38.

In order to compensate for imperfect alignment of the substantially oval rail section 38', the rollers 94, 96, 98 and 100 may be adjusted vertically to assure contact the upper substantially oval surface 86 and lower substantially oval surface 88 of the stationary substantially oval rails 38 by using an eccentric mounting pin or shaft 90 having an offset shaft 160 including a distal threaded portion 162 to receive a fastener or nut (not shown) to affix the rollers 94, 96, 98 and 100 to the chassis assembly 18 extending outwardly from a proximal bolt head 164 configured to engage each of the rollers 94, 96, 98 and 100 such that rotation of eccentric mounting pin or shaft 90 moves each corresponding rollers 94, 96, 98 and 100 vertically into operative engagement with the corresponding upper substantially oval surface 86 and lower substantially oval surface 88 and secured in place with the corresponding fastener or nut (not shown).

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A personal stair lift to transport an individual up and down a stairway comprising a chair assembly supported on a rail assembly by a chassis assembly configured to support a lift mechanism including a drive member coupled to a reversible motor wherein said rail assembly comprises a rail disposed on each side of said chassis assembly, each said rail including an upper surface and a lower surface and said chassis assembly comprises a first upper roller and a first lower roller held in rolling engagement with said upper surface and said lower surface respectively by corresponding mounting shafts coupled to a roller bracket attached to a corresponding side of said chassis assembly to selectively move said chair assembly along said stairway when said reversible motor rotates said drive member and a brake assembly to stop movement of said chair assembly and said chassis assembly along said rail assembly when said chair assembly and said chassis assembly exceed a predetermined speed, said brake assembly comprising a brake drive member rotatably mounted to said chassis assembly and disposed to engage said upper surface of each said rail opposite said rack mounted on one end portion of a corresponding pin and a brake member including a plurality of braking elements pivotally mounted to the opposite end portion of said corresponding pin whenever said brake member is normally retained in a first or neutral position by a brake retainer member such that said plurality of braking elements are held out of engagement with said upper surface of said rail having said rack mounted thereon, said brake assembly further including a brake mechanism movable between a neutral position and a braking position comprising an actuator member pivotally coupled to said brake member by a pivot member normally retained in a first position by an actuator retainer member and a brake actuator pin affixed to said brake member adjacent said actuator member such that when said chair assembly and said chassis assembly exceed said predetermined speed rotation of the brake drive member actuates a brake actuator positioning assembly causing said actuator member to pivot against the force of said actuator retainer member engaging said brake actuator pin rotating said brake member on said brake shaft or pin against the force of said brake retainer member causing said plurality of braking elements to engage said upper surface of said rail to stop said chair assembly and said chassis assembly, said brake actuator positioning assembly comprising a first brake actuator member positioning mechanism to control the pivotal movement of said brake actuator member relative to said brake drive member and pin and a second brake actuator member positioning mechanism to control the movement of said brake actuator member relative to said brake actuator pin, said first brake actuator member positioning mechanism comprising a first actuator positioning element including a first engagement surface formed in a circular flange affixed to said pin to rotate with said brake drive member or roller and a second actuator positioning element including an actuate or concave seat affixed to said brake actuator member disposed to selectively engage each other in response to the operation of said second brake actuator member positioning mechanism, said first brake actuator member positioning mechanism comprising a plurality of first actuator positioning elements and said second brake actuator member positioning mechanism comprising a cam roller rotatably mounted within a slot or recess formed through or in said brake actuator member adjacent said second actuator positioning element and a cam including a plurality of cam surfaces corresponding to said plurality of first actuator positioning elements attached to said brake pin disposed to engage said cam roller as said brake drive member and said brake shaft rotate such that the personal stair lift travels along said rail, engagement between said cam roller and said cam surfaces in combination with said actuator retainer member causes said brake actuator arm or member to rock or oscillate on said pivot member allowing said second actuator positioning element to clear beneath said first engagement surface of said first actuator positioning element and when the speed of said personal stair lift exceeds said predetermined level the speed of rotation of the brake drive member rotates said brake shaft at an increased speed increasing said rotational speed of said cam and said cam surfaces engaging said cam roller such that said brake actuator arm is rotated to said second position against the force of said actuator retainer member for sufficient period of time causing said first engagement surface of said first actuator positioning element to engage said second actuator positioning element, rotating said brake actuator arm against said brake actuator pin to rotate said brake member until said plurality of elements engage said upper surface of said rail to stop said personal stair lift, wherein said lift mechanism is coupled to a transmission assembly by said drive member to selectively move said chassis assembly and wherein each said rail includes a transmission channel and wherein said transmission assembly comprises a transmission guide channel including substantially parallel side walls disposed between said transmission channels having a rack disposed within one of said transmission channels formed on the inner portion of one of said rails and a gear disposed in operative engagement with said rack coupled to said drive member of said reversible drive motor.

2. The stair lift of claim 1 wherein said rail assembly comprises a base having a rail mounting groove formed on the lower portion of opposite sides of thereof to receive a portion of a lower rail mount assembly and a portion of an upper rail mount assembly to secure said personal stair lift in place.

3. The personal stair lift of claim 2 wherein said lower rail mount assembly and said upper rail mount assembly each comprises a stationary substantially flat mounting bracket having at least one pivot mounting flange extending therefrom fixed to the floor next to the stairway and at least one substantially L-shaped rail mounting member pivotally coupled to said pivotal mounting flange by a corresponding mounting pin configured to be disposed in said rail mounting groove.

4. The personal stair lift of claim 1 wherein said rail assembly comprises a plurality of substantially oval rail sections each including end portion disposed on opposite sides of said chassis assembly coupled together by a pair of rail section retaining plates including a plurality of retaining apertures slipped or placed into an upper rail section retaining slot and a lower rail section retainer slot formed on said carriage assembly aligning each retaining aperture with a corresponding retaining aperture formed on said end portion of adjacent substantially oval rail section and secured in place by fasteners.

5. The personal stair lift of claim 4 wherein each said substantially oval rail section includes a longitudinal center line and said retaining apertures have a central axis inclined relative to said longitudinal center line of each said substantially oval rail section such that said fasteners pull adjacent substantially oval rail sections together in alignment relative to each other.

6. The personal stair lift of claim 5 further including a pair of rail section alignment members including an enlarged end portion to be press-fitted into a corresponding retention groove formed on the end portion of each said substantially oval rail section and a reduced end portion slipped into a corresponding retention groove formed on the end portion of an adjacent substantially oval rail section.

7. The personal stair lift lift of claim 1 further including a second upper roller disposed on opposite sides of said rail assembly to engage the upper substantially oval surface of the corresponding substantially oval rail and a second lower roller disposed on opposite sides of said rail assembly adjacent said first upper roller on the same side of said rail assembly to engage the upper substantially oval surface of said corresponding substantially oval rail and said lower set of rollers comprises a pair of first lower rollers disposed on opposite sides of said rail assembly to engage the lower substantially oval surface of the corresponding substantially oval rail and a pair of second lower rollers disposed on opposite sides of said rail assembly adjacent said first lower roller on the same side of said rail assembly to engage said lower substantially oval surface of said corresponding substantially oval rail.

8. The personal stair lift of claim 1 further including a transmission engagement member mounted on said drive member to engage one of said side walls of said transmission guide channel opposite said rack to maintain alignment of said drive member and operative engagement between said rack and said gear.

9. The personal stair lift of claim 8 wherein said transmission engagement member comprises a roller or cam mounted on said drive member.

10. The personal stair lift of claim 1 further including an elongated flexible strip extending substantially the length of said personal stair lift to substantially enclose said transmission channels and said transmission guide channel.

11. The personal stair lift of claim 10 wherein said elongated flexible strip including a longitudinally disposed peripheral bead attached to the inner portion of one of said stationary substantially oval rail sections includes a mounting groove to operatively receive said longitudinally disposed peripheral bead therein.

* * * * *